United States Patent [19]

Coldren et al.

[11] 4,072,543

[45] Feb. 7, 1978

[54] DUAL-PHASE HOT-ROLLED STEEL STRIP

[75] Inventors: Arthur P. Coldren; Geoffrey Tither; Douglas V. Doane, all of Ann Arbor, Mich.

[73] Assignee: Amax Inc., New York, N.Y.

[21] Appl. No.: 761,952

[22] Filed: Jan. 24, 1977

[51] Int. Cl.[2] ..... C21D 7/14; C21D 9/46

[52] U.S. Cl. ..... 148/12 F; 148/36

[58] Field of Search ..... 148/36, 12 F

[56] References Cited

U.S. PATENT DOCUMENTS

| | | | |
|---|---|---|---|
| 3,787,250 | 1/1974 | Korchynsky et al. | 148/12 F |
| 3,902,927 | 9/1975 | Pernstal | 148/12 F |
| 3,928,086 | 12/1975 | Bailey | 148/12 F |
| 3,930,907 | 1/1976 | Bailey | 148/12 F |
| 3,947,293 | 3/1976 | Takechi et al. | 148/12 F |
| 3,970,483 | 7/1976 | Spaeder | 148/36 |
| 4,033,789 | 7/1977 | Hamburg et al. | 148/12 F |

*Primary Examiner*—W. Stallard

*Attorney, Agent, or Firm*—Harness, Dickey & Pierce

[57] ABSTRACT

A dual-phase hot-rolled steel strip and method of making same which is characterized by a microstructure in the as-rolled condition of discrete islands of hard martensite dispersed through a substantially continuous matrix of soft polygonal ferrite and containing as its essential alloying constituents, about 0.05% to about 0.11% carbon, about 0.6% to 1.8% manganese, about 0.7% to about 1.2% silicon, about 0.2% to about 0.4% molybdenum, about 0.3% to about 0.9% chromium, up to about 0.1% vanadium, and the balance consisting essentially of iron along with the usual impurities and residuals present in conventional amounts. The high strength low alloy steel is further characterized as having good initial formability properties and work hardening characteristics, rendering it eminently suitable for the fabrication of structural components for automobiles, such as bumpers, wheel components and the like.

6 Claims, 2 Drawing Figures

DUAL-PHASE HOT-ROLLED STEEL STRIP

BACKGROUND OF THE INVENTION

The shortage and increasing cost of petroleum products has stimulated considerable research and development work to reduce the weight of automobile vehicles in order to increase efficiency and gasoline mileage. One such technique under investigation is the use of a thinner gauge, higher strength steel for fabrication of vehicle structural components, such as bumper face bars, wheel components and structural brackets such as engine mounts and the like in place of conventional structural steels employed requiring thicker gauges for achieving the same strength of the resultant vehicle component. Various high strength low alloy steels of a minimum yield strength of about 80,000 pounds per square inch (550 MPa) are known which incorporate elements such as columbium, vanadium, or titanium as secondary hardening addition agents. In spite of the weight saving advantages afforded by such high strength low alloy steels, a widespread adoption thereof on a commerical scale has been inhibited due to the necessity or redesigning the specific components and providing new tooling for their fabrication due to the reduced formability of such steels due to their higher strength and resistance to deformation and elongation.

In order to overcome such problems, it has heretofore been suggested to subject certain ones of such high strength low alloy steels in an as-rolled condition to a post heat treatment to effect a conversion thereof to a two-phase microstructure and in which transformed and annealed condition, the heat treated steel is of a lower initial yield strength, facilitating its formability and deformation during fabrication into automobile components. The work hardening to which the steel is subjected during such fabrication operations causes an increase in its yield strength to a magnitude generally equal to that of its original as-rolled condition. While such a post heat treatment of high strength low alloy steels to produce a formable two-phase steel strip overcomes many of the problems associated with the formation and fabrication of lightweight, high strength automobile components, the high cost and complexity of such post heat treatment steps has detracted from a more widespread adoption of such heat treated steels. Moreover, the post heat treatment cycle requires special facilities, requiring a substantial investment or capital expenditure in order to practice the process, further detracting from a widespread commercial acceptance thereof.

The problems and disadvantages associated with the foregoing post heat treatment process are overcome in accordance with the improved high strength low alloy steel of the present invention and its method of manufacture, whereby the resultant steel strip is produced in an as-rolled condition possessed of a dual-phase microstructure, obviating the need for subjecting the steel strip product to a post heat treatment cycle, thereby avoiding the cost associated with such further processing. Moreover, the dual-phase hot-rolled steel strip of the present invention can readily be produced employing conventional hot strip mill production practices without modification, and wherein the resultant steel strip product is characterized as having a low initial yield strength and satisfactory elongation characteristics, enabling deep drawing thereof employing conventional tooling at conventional press forces without encountering fracture or tearing of the stock during formation. The high work hardening characteristic of the steel strip product effects an increase in its yield strength during fabrication to a magnitude of about 80 ksi, enabling the use of thinner gauges and a corresponding significant reduction in the weight of the automobile components over conventional parts made from present-day moderate strength steels.

SUMMARY OF THE INVENTION

The benefits and advantages of the present invention are achieved by a careful control of the alloy chemistry of a high strength low alloy steel, whereby the resultant so-called "hot band" or steel strip product produced by conventional hot strip mill processing is possessed of a dual-phase microstructure in the as-rolled condition, comprising a predominantly soft polygonal ferrite matrix having interspersed therethrough discrete islands or phases of hard martensite. The chemistry of the steel is carefully controlled to provide a continuous cooling transformation diagram which is conducive to the formation of a dual-phase steel of the aforementioned microstructure employing temperatures and cooling rates normally encountered in hot strip mill operations. The chemistry of the low alloy steel of the present invention is controlled to provide a carbon content ranging from about 0.05% to about 0.11%; a manganese content of about 0.6% to about 1.8%; a silicon content of about 0.7% to about 1.2%; a molybdenum content of about 0.2% to about 0.4%; a chromium content of about 0.3% to about 0.9%; vanadium as an optional constituent present in amounts up to about 0.1%, with the balance consisting essentially of iron along with conventional impurities and normal residuals present in amounts which do not significantly affect the physical properties and microstructures of the resultant steel alloy product. A particularly satisfactory alloy in accordance with the practice of the present invention nominally contains 0.07% carbon, 1.2% manganese, 0.9% silicon, 0.4% molybdenum, 0.6% chromium, with the balance consisting essentially of iron.

In accordance with the process aspects of the present invention, the slab prior to rolling in the roughing stands is heated in a furnace to a temperature usually ranging from about 2200° F to about 2300° F for a period of time sufficient to place the steel in the austenite condition, whereafter the steel is passed through the roughing stands, is subjected to a holding step, whereafter it enters the finishing stands and thereafter is subjected to a controlled cooling by water spray application on the run-out table in accordance with conventional hot strip mill practices. The finished steel strip is cooled to a coiling temperature ranging from about 1000° F to about 1200° F prior to coiling and the resultant coil is permitted to air cool at a conventional rate of about 50° F per hour corresponding to the normal commercial air cooling rate of large coils or hot band.

Additional benefits and advantages of the present invention will become apparent upon a reading of the description of the preferred embodiments taken in conjunction with the accompanying drawing.

DESCRIPTION OF THE PREFERRED EMBODIMENTS

Figure 1:
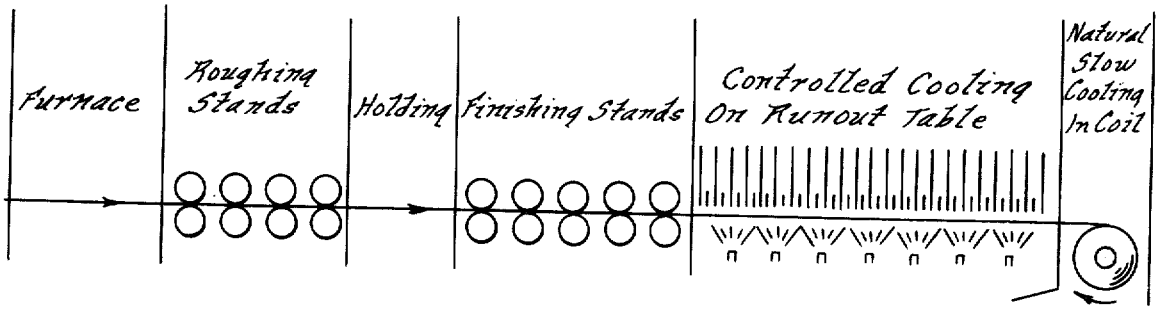
FIG. 1 is a schematic view illustrating a typical sequence of operations in accordance with commercial hot strip mill operations for producing a hot-rolled steel strip product.

The essential alloying constituents and the broad permissible as well as preferred concentrations thereof in the high strength low alloy dual-phase hot-rolled steel strip product of the present invention are set forth in Table 1.

TABLE 1

| Constituent | Composition - (Weight Percent) Permissible | Preferred |
|---|---|---|
| Carbon | 0.05 - 0.11 | 0.07 |
| Manganese | 0.6 - 1.8 | 1.2 |
| Silicon | 0.7 - 1.2 | 0.9 |
| Molybdenum | 0.2 - 0.4 | 0.3 - 0.4 |
| Chromium | 0.3 - 0.9 | 0.5 - 0.7 |
| Vanadium | up to 0.1 | |
| Iron | balance | balance |

The concentration of carbon as set forth in Table 1 is controlled within a range of about 0.05% to about 0.11% for the purpose of controlling the resultant quantity of martensite in the dual-phase polygonal ferrite matrix in the as-rolled condition. Generally, the carbon concentration as set forth in Table 1 provides for a controlled range of martensite ranging from about 5% up to about 15% by volume of the steel matrix. The relatively low carbon concentration in the steel also enhances its weldability characteristics. Manganese can permissibly be used within a range of about 0.6% to about 1.8% by weight, while silicon can be present within a range of about 0.7% to about 1.2%. The silicon and manganese constituents contribute to solid solution strengthening of the basic polygonal ferrite matrix and also effect a modification of the continuous cooling transformation diagram, lengthening the time for effecting a transformation of the austenite. The molybdenum constituent is incorporated in controlled amounts ranging from about 0.2% to about 0.4% of the alloy and also contributes to solid solution strengthening of the steel and a modification of the continuous cooling transformation (CCT) diagram in a manner to avoid the transformation of austenite into pearlite and bainitic cementite. The chromium constituent is another alloying agent that inhibits the formation of cementite, and can be employed in amounts from about 0.3% to about 0.9% by weight of the alloy, although amounts generally in a range of about 0.5% to about 0.7% by weight are preferred. Vanadium comprises an optional alloying constituent and can be employed in amounts up to about 0.1% by itself, or as a partial replacement for the chromium constituent. The chromium and vanadium alloying addition agents contribute strength to the alloy and a shift of the bainite region of the CCT diagram downwardly, suppressing the formation of bainite during the cooling cycle. The use of carbon, silicon, manganese, molybdenum and chromium in amounts above those set forth in Table 1 as permissible maximum quantities is undesirable due to an excessive shift of the CCT diagram, whereby the transformation of austenite to bainite rather than polygonal ferrite is promoted. A particularly satisfactory steel composition which provides the benefits of the present invention nominally contains about 0.07% carbon, about 1.2% manganese, about 0.9% silicon, about 0.4% molybdenum, about 0.6% chromium, and the balance consisting essentially of iron along with conventional impurities and residuals present in usual amounts.

In addition to the essential and optional alloying constituents as set forth in Table 1, the steel composition of the present invention may additionally contain aluminum as a deoxidation residual in amounts generally ranging up to about 0.08%, while amounts ranging from about 0.02% to about 0.05% are more usual and preferred. Nitrogen may also be present as an impurity in amounts usually ranging from about 0.004% up to about 0.015%, with the specific quantity present varying as a function of the specific steel-making procedure employed for forming the ingot. Phosphorus and sulfur also comprise conventional impurities and are conventionally maintained at levels as low as commerically practical. The concentration of phosphorus as an impurity in the steel is generally controlled below about 0.04%, while concentrations as low or lower than about 0.01% are preferred. Sulfur is controlled in amounts up to a maximum of 0.006% or in the alternative, rare earth additives are incorporated in the steel to control and/or modify the resultant sulfide inclusion and control of their shape, whereby the influence of the sulfur impurity is minimized.

By a control of the alloy chemistry of the steel comprising the present invention within the limits as hereinabove described and as set forth in Table 1, ingots or slabs of such alloys can be transformed into hot band or hot-rolled steel strip employing conventional commercial hot strip mill practices in accordance with the schematic arrangement as illustrated in FIG. 1. As shown, the slab or ingot of the steel alloy is heated in a furnace at a temperature and for a period of time sufficient to convert the microstructure to the austenite phase without incurring undesirable grain growth of the ingot. Conventionally, furnace temperatures ranging for 2200° F to about 2300° F are satisfactory for this purpose. The resultant reheated ingot or slab next passes through the roughing stands at temperatures normally ranging from about 1900° F to about 2150° F, followed by a holding period in which further air cooling thereof occurs to a temperature of about 1800° F. The slab thereafter enters the finishing stands and is finish-rolled to the desired thickness, which for strip stock conventionally is of a magnitude of about ¼ inch or less in thickness. The strip upon emerging from the finishing stands at about 1600° F travels along a run-out table in which it is subjected to a controlled cooling at rates normally ranging from about 18° F to about 90° F per second. The controlled cooling of the strip is effected so that the strip entering the coil is at a temperature normally ranging from about 1000° F up to about 1200° F corresponding to the coiling temperature, whereafter the strip undergoes a natural slow air cooling at commercial rates which normally are about 50° F per hour.

Figure 2:
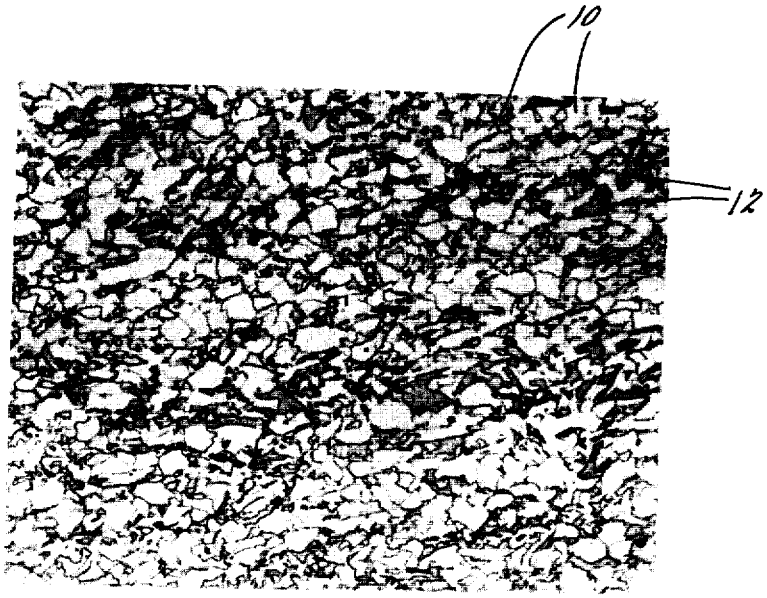
FIG. 2 is a photomicrograph at a magnification of 1,000 times, illustrating the dual-phase microstructure of the hot-rolled steel strip product produced in accordance with the present invention in an as-rolled condition.

The resultant as-rolled steel strip is characterized as having a dual-phase microstructure, as may be best seen in FIG. 2, comprised of a soft polygonal ferrite matrix indicated at 10, having interspersed therethrough discrete islands of martensite, indicated at 12. It will be appreciated that the soft polygonal ferrite matrix may contain up to about 20% by volume bainite without adversely affecting the low initial yield strength and formability characteristics of the steel strip. The martensite phase may range from about 5% up to about 15% martensite, while the combined amount of martensite plus bainite may range from about 10% to about 30 volume percent. The discrete martensite phases may also contain small amounts of untransformed austenite therein. It will be apparent from the foregoing strip mill fabrication practice that the slab initially heated to place it in an austenitic condition is subjected to air cooling during the roughing and finishing stages of rolling, and followed by rapid controlled cooling on the run-out table, causing a partial transformation of the austenite to polygonal ferrite, whereafter an interruption of the transformation of austenite is effected upon entering the coil, whereafter a completion of the transformation of austenite to produce discrete interspersed phases of martensite is completed during the cooling of the coil.

In order to further illustrate the dual-phase steel composition and process for fabrication comprising the present invention, a series of sample heats were prepared and were subjected to simulated commercial hot strip mill fabrication employing controlled cooling rates. The chemical compositions of samples A–G and the offset yield strength, tensile strength and total elongation properties obtained on the resultant samples are set forth in Tables 2 and 3.

TABLE 2

| Constituent | Chemical Composition, Percent by Weight — Steel Sample A | B | C | D | E | F | G |
|---|---|---|---|---|---|---|---|
| Carbon | 0.066 | 0.074 | 0.072 | 0.065 | 0.065 | 0.065 | 0.072 |
| Manganese | 1.19 | 1.18 | 1.18 | 1.19 | 1.19 | 1.19 | 1.18 |
| Silicon | 0.87 | 0.88 | (0.88) | (0.87) | (0.87) | (0.87) | (0.88) |
| Molybdenum | 0.29 | (0.39)[b] | (0.39) | 0.38 | (0.38) | (0.38) | (0.49) |
| Chromium | 0.32 | (0.40) | 0.50 | 0.61 | 0.90 | (0.90) | (0.50) |
| Vanadium | —[a] | — | — | — | — | 0.11 | 0.08 |
| Aluminum | 0.064 | (0.069) | (0.069) | (0.064) | (0.064) | (0.064) | (0.069) |
| Nitrogen | 0.005 | (0.004) | (0.004) | (0.005) | (0.005) | (0..005) | (0.004) |
| Phosphorus | 0.010 | (0.012) | (0.012) | (0.010) | (0.010) | (0.010) | (0.012) |
| Sulfur | 0.005 | (0.005) | (0.005) | (0.005) | (0.005) | (0.005) | (0.005) |

[a] — = None added; not analyzed
[b] ( ) = Assumed value, based on analysis of another ingot of split heat

TABLE 3

| Steel Sample | Simulated Coiling Temp. ° C (° F) | Tensile Properties of Example Steel — Offset Yield Strength, MPa (ksi) 0.2% | 2.0% | 3.0% | Plastic Strain at 80 ksi (551 MPa*), % | Tensile Strength MPa (ksi) | Elongation % in 2-Inch Uniform | Total |
|---|---|---|---|---|---|---|---|---|
| A | 620 (1150) | [a] | — | — | — | — | — | — |
| | 580 (1075) | 444 (64.5) | 639 (92.8) | 673 (97.7) | 0.7 | 753 (109.3) | 11 | 18 |
| | 540 (1000) | 460 (66.8) | 658 (95.5) | 690 (100.2) | 0.6 | 753 (109.3) | 10 | 17 |
| B | 650 (1200) | [a] | — | — | — | — | — | — |
| | 620 (1150) | 448[b] (65.0) | 472 (68.5) | 500 (72.5) | — | 597 (86.7) | 15 | 22 |
| C | 635 (1175) | [a] | — | — | — | — | — | — |
| | 620 (1150) | 379 (55.0) | 491 (71.2) | 528 (76.6) | 3.4 | 641 (93.1) | 16 | 23 |
| | 595 (1100) | 367 (53.2) | 546 (79.3) | 588 (85.3) | 2.3 | 691 (100.3) | 13 | 21 |
| D | 620 (1150) | 396 (57.5) | 522 (75.8) | 553 (80.2) | 2.9 | 647 (93.9) | 15 | 24 |
| | 580 (1075) | 381 (55.3) | 582 (84.4) | 614 (89.1) | 1.4 | 704 (102.2) | 14 | 20 |
| | 540 (1000) | 417 (60.5) | 612 (88.8) | 646 (93.7) | 0.7 | 732 (106.3) | 13 | 20 |
| E | 620 (1150) | 420[b] (61.0) | 462 (67.0) | 494 (71.7) | — | 586 (85.1) | 14 | 22 |
| | 580 (1075) | 355 (51.5) | 545 (79.1) | 580 (84.2) | 2.1 | 678 (98.4) | 13 | 19 |
| | 540 (1000) | 424 (61.6) | 604 (87.7) | 637 (92.4) | 1.1 | 709 (102.9) | 10 | 16 |
| F | 620 (1150) | [a] | — | — | — | — | — | — |
| | 580 (1075) | [a] | — | — | — | — | — | — |
| | 540 (1000) | 431 (62.5) | 529 (76.8) | 556 (80.7) | 2.8 | 638 (92.6) | 12 | 18 |
| G | 620 (1150) | 457 (66.3) | 594 (86.2) | 623 (90.4) | 1.2 | 720 (104.5) | 15 | 23 |
| | 595 (1100) | 504 (73.1) | 664 (96.3) | 699 (101.5) | 0.4 | 781 (113.3) | 11 | 17 |

*MPa (Mega Pascals) = Mega newtons per square meter
[a] = Ferrite-pearlite structure; not tested
[b] = Mixed structure containing some pearlite Each of the seven test steel samples were subjected to simulated laboratory hot strip mill rolling operations in which an initial slab of about 1 inch thick was employed which was heated to 2300° F and was finish-rolled at a temperature of 1600° F to produce a final sheet thickness of about 0.1 inch. The cooling rate of the strip from 1600° F to the simulated coiling temperature was controlled at a rate of about 35° F per second. As will be noted in Table 3, the steel sample strips were coiled at different simulated coiling temperatures. The cooling rate in the coil was controlled at about 50° F per hour corresponding to conventional commercial air cooling of large size coils of hot band stock.

Of the foregoing test samples, sample D exhibited the best properties, particularly with respect to its total elongation of 24% when coiled at a temperature of 1150° F.

While it will be apparent that the invention herein described is well calculated to achieve the benefits and advantages set forth above, it will be appreciated that the invention is susceptible to modification, variation and change without departing from the spirit thereof.

What is claimed is:

1. A dual-phase hot-rolled steel strip characterized as having a microstructure in the as-rolled condition comprised of a substantially continuous matrix comprised predominantly of polygonal ferrite having interspersed therethrough discrete islands of martensite, said steel containing as its essential alloying constituents from about 0.05% to about 0.11% carbon, about 0.6% to about 1.8% manganese, about 0.7% to about 1.2% silicon, about 0.2% to about 0.4% molybdenum, about 0.3% to about 0.9% chromium, up to about 0.1% vanadium, and the balance consisting essentially of iron along with the conventional impurities and residuals present in the usual amounts.

2. The steel strip as defined in claim 1, in which said discrete islands of martensite comprise from about 5% up to about 15% by volume of the steel microstructure.

3. The steel strip as defined in claim 1, in which said matrix of polygonal ferrite contains up to about 20% by volume bainite.

4. The steel strip as defined in claim 1, in which the carbon content is about 0.07%, the manganese content is about 1.2%, the silicon content is about 0.9%, the molybdenum content is about 0.3% to about 0.4%, the chromium content is about 0.5% to about 0.7% with the balance consisting essentially of iron.

5. The steel strip as defined in claim 1, in which the carbon content is about 0.07%, the manganese content is about 1.2%, the silicon content is about 0.9%, the molybdenum content is about 0.4%, the chromium content is about 0.6%, with the balance consisting essentially of iron.

6. The method of making a dual-phase hot-rolled steel strip characterized as having a microstructure in the as-rolled condition comprised of a matrix of polygonal ferrite having interspersed therethrough discrete islands of martensite which comprises the steps of forming a solidified mass of an alloy consisting essentially of about 0.05% to about 0.11% carbon, about 0.6% to about 1.8% manganese, about 0.7% to about 1.2% silicon, about 0.2% to about 0.4% molybdenum, about 0.3% to about 0.9% chromium, up to about 0.1% vanadium, and the balance consisting essentially of iron along with the usual impurities and residuals present in conventional amounts; heating said mass to an elevated temperature for a period of time sufficient to convert the microstructure of said mass to the austenitic form, deforming said mass in the temperature range of about 2150° F to about 1600° F, followed by cooling at a controlled cooling rate through a transformation range whereby the predominant portion of austenite is transformed to polygonal ferrite in a manner to avoid the formation of appreciable amounts of pearlite, coiling the deformed said mass into a coil at a coiling temperature ranging from about 1000° F to about 1200° F and thereafter permitting said coil to further air cool and effect a transformation of the predominant remaining portion of austenite to martensite in the form of discrete islands interspersed through the substantially continuous polygonal ferrite matrix.

* * * * *